United States Patent [19]

Gordon

[11] 4,215,857

[45] Aug. 5, 1980

[54] ATHLETE'S LANDING PIT

[76] Inventor: Donald W. Gordon, 2718 Standish, Anaheim, Calif. 92806

[21] Appl. No.: 651,674

[22] Filed: Jan. 23, 1976

[51] Int. Cl.[3] ..... A63B 5/18

[52] U.S. Cl. ..... 272/101; 5/465

[58] Field of Search ..... 272/101, 109; D6/201; 5/338, 344, 345, 361 B, 355, 417, 481, 461, 465

[56] References Cited

U.S. PATENT DOCUMENTS

| | | | |
|---|---|---|---|
| 3,026,544 | 3/1962 | Persicke et al. | 5/361 BX |
| 3,369,808 | 2/1968 | Sconce | 272/101 |
| 3,513,491 | 5/1970 | Gordon | 272/101 X |
| 3,892,401 | 7/1975 | Sorenson | 272/101 |
| 3,892,402 | 7/1975 | Montour | 272/101 |

FOREIGN PATENT DOCUMENTS

| | | | |
|---|---|---|---|
| 665548 | 5/1929 | France | 5/345 R |
| 1324907 | 3/1963 | France | 5/345 R |

*Primary Examiner*—Robert W. Michell
*Assistant Examiner*—Arthur S. Rose
*Attorney, Agent, or Firm*—Knobbe, Martens, Olson, Hubbard & Bear

[57] ABSTRACT

An athlete's landing pit, particularly useful as a landing surface for high jumpers and pole-vaulters, is formed through the side-by-side arrangement of plural foam logs. The individual logs are shaped to provide air spaces within the foam structure to lend resilience to the landing surface. The individual logs of foam are not necessarily glued to each other but may be simply arranged side-by-side and placed within a fabric covering which is used to maintain the arrangement of the logs. The individual logs are therefore easily stored and replaceable individually. In addition, the individual logs within the landing pit structure may be placed at different locations each time the landing pit is constructed in order to avoid excessive wear on any individual log element.

10 Claims, 8 Drawing Figures

ATHLETE'S LANDING PIT

BACKGROUND OF THE INVENTION

This invention relates to athlete's landing pits and more particularly to aboveground pits constructed of foam block cushioning units.

The most widely used aboveground landing pit today is that constructed in accordance with the teachings of my prior U.S. Pat. No. 3,513,491 issued May 26, 1970. That patent described an improvement over a scrap foam landing pit accomplished by constructing a three-layer pit wherein each of the bottom two layers are constructed of horizontally spaced stiff foam blocks, the blocks of one layer running perpendicular to the blocks of the other layer, and a relatively soft continuous upper layer. Each of the blocks and continuous layer are cemented together to form a unitary structure which is then enclosed within a fitted casing of rectangular box form having a base section of waterproof vinyl coated fabric which is substantially air impervious and a top section of breather fabric, that is, fabric which is constructed, for example, as open weave nylon which is coated with vinyl and is air pervious. Since the present invention is an improvement over the landing pit defined and described in U.S. Pat. No. 3,513,491, I hereby incorporate the descriptive material of that patent by reference and particularly those portions of that patent which describe the general use and nature of aboveground foam landing pits.

Certain difficulties are encountered with the use of my prior landing pit, the most significant of which is the tendency of the continuous soft upper foam layer to tear at locations where it bridges a gap between spaced horizontal blocks in the middle layer. Such tears eventually lead to weak spots and holes on the top cushion layer of the pit which are dangerous to jumpers.

An additional difficulty encountered with my prior pit is the fact that both high jump and pole-vaulting pits are typically constructed as three large cushioning members which are attached to one another by hooks or straps. These members tend to separate from one another as the pit is used for an extended period of time, creating a weak point between the sections. In addition, each of these large sections is relatively heavy and difficult to move and store, and since the sections are manufactured as a unit, that is, are held together by adhesive, they cannot be dismantled for easy transportation or storage.

SUMMARY OF THE INVENTION

The present invention provides a solution to the problems which I have encountered with my prior landing pit, and specifically to the transportation, storage, and structural integrity problems cited above. This is accomplished by providing a two-layer foam landing pit rather than a three-layer pit, each of the layers formed of foam blocks or logs which are abutted to one another in a horizontal direction but which are formed to provide a matrix structure having air spaces to provide a cushioned landing surface. In one example, the individual foam blocks or logs are coffin shaped, that is, the logs are shaped to have a plane top intersecting at right angles with plane side members which extend from the top approximately halfway to the bottom of the log. At this halfway point, the sides extend downward to form a truncated triangle with the bottom plane surface. When plural logs are positioned side-by-side, this embodiment forms triangular air spaces running the length of the logs between the logs. The outside logs include a plane outer face to form a rectangular outer perimeter for the landing pit. The air spaces of the two layers are adjacent one another, that is, the air space triangular channels of the bottom layer face upwardly while the air space triangular channels of the upper layer face downward, to provide a lattice air space structure between the layers.

While the individual logs or blocks are not glued to one another but rather simply positioned in place, the shape which has been selected for the logs provides a uniform abutting upper surface for the landing pit which is structurally supported at all locations and which will not be susceptible to tearing after repeated use. The individual logs or blocks, when stacked together, are held in place by a casing having a rectangular box form which fits around the composite logs tightly to hold them adjacent one to another. This construction provides a unitary landing pit assembly without the necessity of constructing individual large box elements which must be fastened together, as in my prior art patent. The unitary construction assures that spaces will not be generated between individual blocks after repeated use.

The present construction therefore permits a unitary foam landing pit to be made using a lattice structure held together by the outside casing and lending itself to easy transportation and storage by removal of the outside cover and individual portage of the log elements. It should be noted additionally that the individual logs within the structure may be position rotated on successive assemblies of the pit structure so that excessive wear in certain locations of the pit structure may be distributed to the various log elements.

These and other advantages of the present invention are best understood through a reference to the drawings, in which.

DETAILED DESCRIPTION OF THE PREFERRED EMBODIMENT

Figure 1:
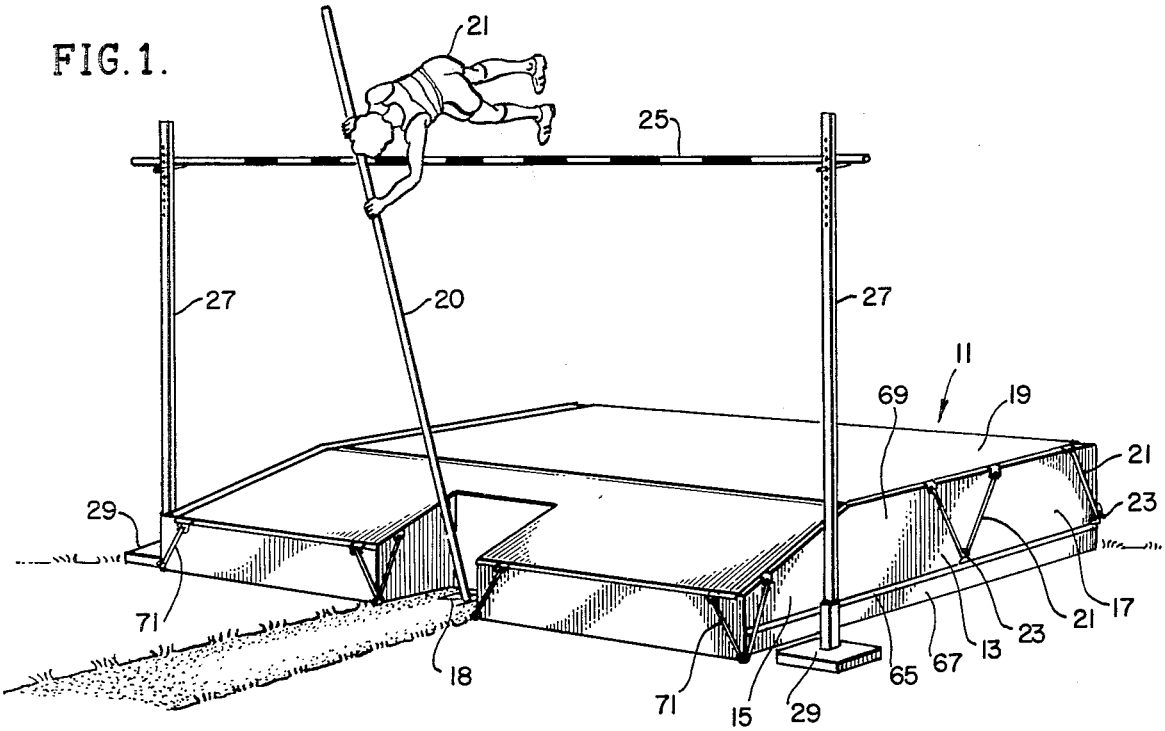
FIG. 1 is a perspective view of the assembled landing pit used for pole-vaulting.

Referring initially to FIG. 1, the landing pit 11 of the present invention is shown to include a substantially rectangular main pit portion 13 and an inclined front pit portion 15 surrounding the plant box 18 which receives a pole 20 used by a pole-vaulter 21. The rectangular portion 13 and inclined front portion 15 are formed as a unitary pit structure which is covered by a fitted casing 17 conforming to and surrounding the sides and bottom of the pit 11. The casing 17 is air and moisture impervious at all locations around the side and bottom of the pit 11 but is manufactured of breather material which is air pervious on the top layer of the pit 11. In addition, a layer of breather material 19 may be stretched over the top surface of the pit 11 to provide added protection for the pit 11. It will be understood that this layer of breather material 19 may be changed as it wears and is used to protect the pit 11 from athlete's spikes and sunlight. This layer 19 is stretched over the pit 11 by plural nylon straps 21 which are sewn to the breather material layer 19 and are held onto plural hooks 23 positioned at spaced intervals around the pit 11. The nylon straps 21 themselves are not resilient, but the inherent resilience of the foam within the pit 11 provides sufficient resilience to permit the straps 21 to be drawn over the hooks 23 to maintain the layer 19 taut.

As is common, the bar 25 provided for pole-vaulting is balanced on a pair of upright posts 27 which are positioned in standards 29 located alongside the pit 11. These standards 29 are typically movable along the sides of the pit 11 to permit the position of the bar 25 to be adjusted toward and away from the front of the pit 11.

Figure 2:
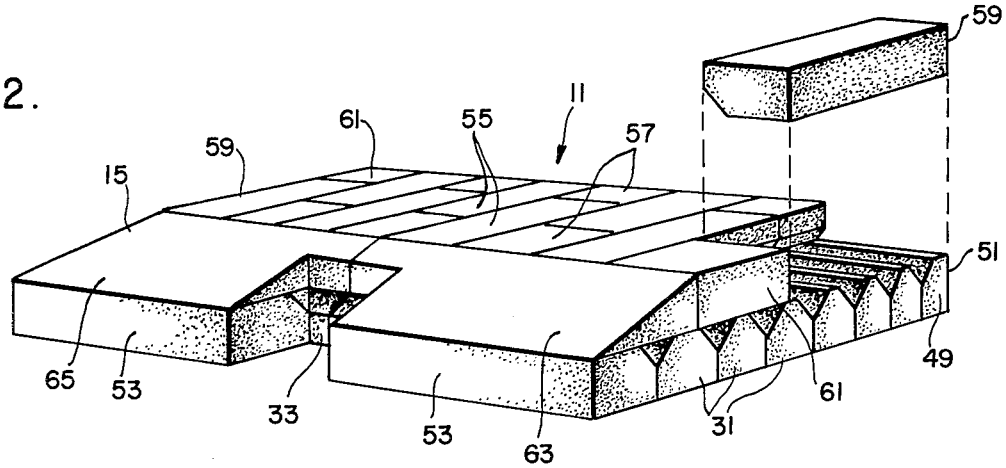
FIG. 2 is a perspective view similar to the perspective view of FIG. 1 but showing the pit construction with the outside casing removed so that the arrangement of the foam blocks or logs can be seen.
Figure 3:
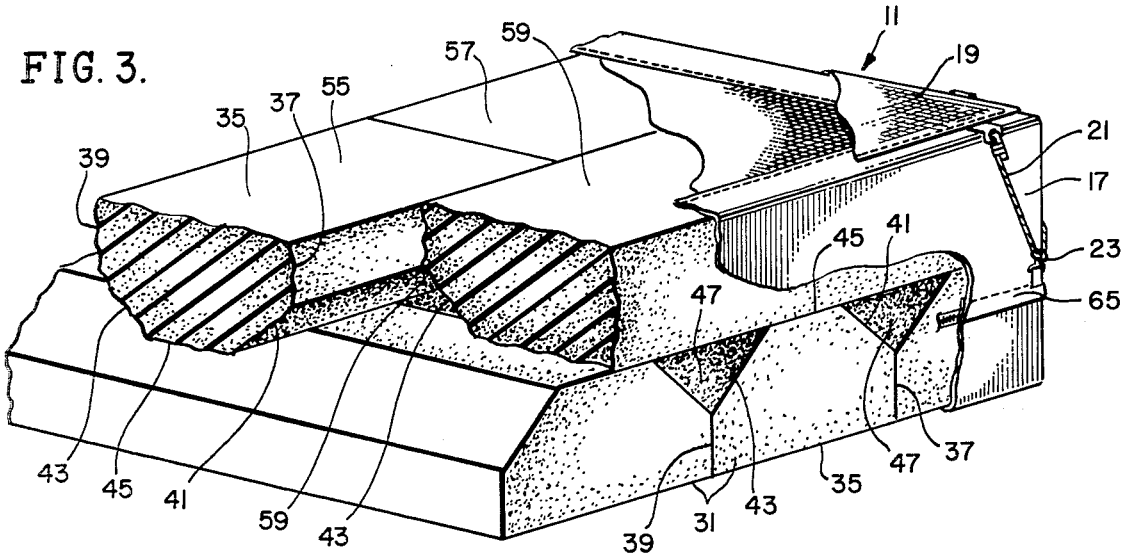
FIG. 3 is a perspective view, partially broken away, of one corner of the landing pit of FIGS. 1 and 2 showing the interrelationship between the various elements thereof.

Referring now specifically to FIGS. 2 and 3, the arrangement of the foam blocks or logs within the cover 17 will be described. A first plurality of logs 31, each having a length which is equal to half the width of the landing pit 11, are arranged in side-by-side relationship on the ground. It will be understood that the bottom portion of the cover 17 is first laid on the ground to form a protective cover underneath the blocks 31. After the blocks 31 are assembled on this lower portion of the cover 17, the upper portion of the cover 17 may be laid over the top of the blocks and the upper and lower cover portions may be zipped together.

The blocks 31 are arranged end-to-end with an identical set of blocks, one of which is shown at 33 in FIG. 2, to form the base layer of the lattice structure for the pit 11. As best shown in FIG. 3, each of the blocks 31 and 33 is shaped as an inverted coffin, that is, the blocks 31, 33 each include a planar lower surface 35 intersecting normally with a pair of planar side portions 37 and 39 which extend approximately half the height of the blocks 31, 33. At this approximate halfway point, the planar sides 37 and 39 which extend normal to the lower surface 35 terminate, and the remaining upper portion of the blocks 31, 33 is formed, in section, as a truncated triangular member with sides 41 and 43 extending diagonally toward a planar top portion 45 which is parallel to the lower surface 35 and has a width which is approximately one-half the width of the planar lower surface 35. When these blocks 31 are arranged in a side-by-side configuration as shown, plural V-shaped air spaces 47 result, which air spaces provide added resilience to the landing pit 11 which would not be available if the blocks 31 were formed as solid rectangular slabs of foam material. It should be appreciated, particularly in reference to FIG. 2, that a block 49 is placed alongside the last block 31 in the array, the block 49 having a planar side 51 having no diagonally formed surface. This block 49 serves to terminate the landing pit with rectangular surfaces to conform to the cover 17. In addition, a pair of frontal blocks 53 are likewise formed with one planar side to present a finished edge for the landing pit 11, the blocks 53 being shorter than the blocks 49 to provide an opening around the plant box 18.

Arranged on top of the blocks 31 is a second layer of foam blocks made up of long blocks 55 and relatively short blocks 57. Each of these blocks 55 and 57 is formed with an identical coffin shape as that described for the blocks 31, and includes a planar upper surface 35, normally extending planar side surfaces 37 and 39 intersecting with diagonally extending side surfaces 41 and 43, which in turn intersect with a planar lower surface 45 having a width which is approximately one-half the width of the planar upper surface 35. In other words, the blocks 55 and 57, except for their length, are identical to the blocks 31, but are inverted so that a continuous top planar surface results for the landing pit. The diagonal surfaces 41 and 43 result in elongate triangular air spaces 59 which run the length of the landing pit 11, intersecting at spaced locations with the laterally extending air spaces 47. This arrangement therefore results in a lattice construction for the pit 11, with a lattice network of air spaces 47 and 59 extending at right angles to one another to increase the cushioning properties of the landing pit 11.

As best seen in FIG. 2, the relative long and short upper blocks 55 and 57 are arranged in alternate front and rear locations as these upper blocks are placed on the lower blocks 31 so that the upper intersections between the blocks 55 and 57 are staggered across the top of the pit. As with the lower layer of blocks 31, 33, this upper layer of blocks 55, 57 includes terminal blocks 59 and 61 which include one planar side for terminating the landing pit 11 to provide a rectangular outer surface to conform with the cover 17.

In addition, a pair of wedge-shaped blocks 63 and 65 are placed at the front of the landing pit 11 on top of the lower blocks 31 to povide the inclined upper frontal surface 15 for the pit 11. Each of the blocks 63 and 65 includes a cutout portion conforming to the reduced length of the frontal blocks 53 to complete the opening above the plant box 18.

As mentioned previously, the blocks 31, 33 are laid in place over the lower portion of the cover 27 and then, as best shown in FIGS. 1 and 3, the upper portion of the cover 17 is drawn over the top of the landing pit 11 and a zipper 65 is used to interconnect the upper and lower portions, completing the pit construction.

Referring to FIG. 1, it should be noted that the zipper 65 runs the entire length of both sides of the landing pit 11 and completely across the rear side of the landing pit 11 but does not run along the front face of the landing pit 11. Thus, the front face of the pit 11 operates much like a hinge during construction or disassembly of the pit 11, and the lower portion 67 of the cover 17 may be laid end-to-end on the ground with the upper portion 69 as an initial step in assembly of the pit 11. Once all of the foam blocks 31, 33, 49, 53, 55, 57, 59 have been laid in place on this lower portion 67, the upper portion 69 may be hinged or folded around the front face of the cover 17 to overlie these foam blocks. The zipper 65 may then be zipped closed around the sides and back of the pit 11 to form a unitary pit structure. It is important to note that the cover 17 is preferably made slightly smaller than the overall dimension of the assembled foamed blocks so that, when zipped together, the cover 17 binds the block assembly together, assuring that no voids exist in the upper planar surface at the intersections of the blocks 55, 57, 59, 63, and to further assure that the lower blocks 31, 33, 49 are abutted against one another along the lower portion 67 of the cover 17.

It will be recognized through a review of FIGS. 1 through 3 that the individual upper foam blocks 55 may be position rotated on successive assemblies of the pit 11. Similarly, the upper foam blocks 57 which are all identical in size and shape may likewise be position rotated. The blocks 31, 33 may be rotated in position also, so that those portions of the pit 11 which are subjected to excessive wear during use may be formed with different foam blocks on different assemblies to spread this excessive wear throughout the pit structure and substantially increase the usable life of the pit 11.

It will also be recognized that the individual foam blocks 31, 33, 49, 55, 57, 59, 63 are each individually transportable and storable so that the entire pit structure may be easily transported by removing the cover 17, folding this cover for transport, and individually transporting and storing the foam blocks at one or more locations as is convenient.

Another important feature of the present invention is the capability of forming a variety of pits 11 from different configurations of the foam blocks. Thus, if the foam blocks of FIGS. 1 through 3 are stacked in different arrangements and a different cover 17 is used, a landing pit useful for different purposes will result. For example, the inclined front mats 63 and shortened frontal blocks 53 may be removed from the landing pit of FIGS. 1 through 3, and the blocks 31, 33 at the front of the pit replaced with rectangular blocks, to form a high jump pit which does not include a space surrounding a plant box 18. This flexibility of construction of the present pit 11 substantially reduces the cost of providing a variety of landing pits for athletics.

Figure 4:
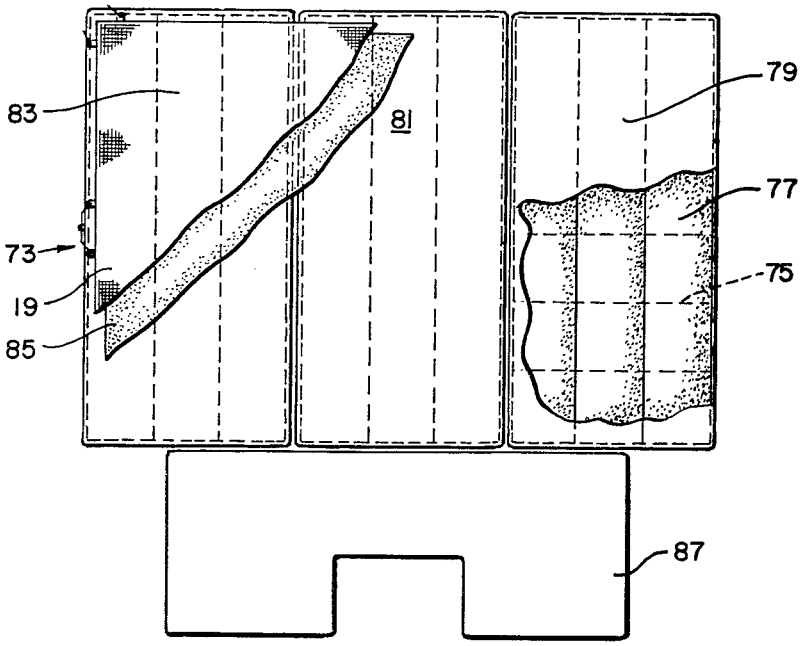
FIG. 4 is a plan view of an alternate embodiment of the landing pit of the present invention.

Referring now to FIG. 4, an alternate embodiment construction of the present invention which is not a unitary pit structure will be described. As shown in my prior patent cited above, landing pits are commonly constructed as plural subassemblies bound together by straps or hooks. As shown in FIG. 4, a landing pit 73 of this type may be constructed using the construction techniques described above. Thus, plural coffin-shaped lower blocks 75, shown in phantom lines in the broken away section of FIG. 4 and having triangular air spaces running laterally across the pit 73 above the blocks 75, may be placed beneath plural upper blocks 77 running longitudinally across the pit 73, each of the blocks 77 being coffin shaped and forming triangular air spaces beneath the blocks 77. Thus, the blocks 75 and 77 form a lattice foam structure with lattice air spaces therebetween. In the construction of the pit 73, however, rather than forming a unitary landing pit structure from the blocks 75 and 77, three identical pit subassemblies 79, 81 and 83 are formed, each enclosed within a conforming rectangular cover 85. These covers, as in the embodiments of FIGS. 1 through 3, are slightly smaller than the assembly of blocks 75, 77, so that they hold the blocks tightly together, resulting in a tight abutment of the upper blocks 77 so that no voids in the upper surface result. These three subassemblies 79, 81 and 83 are juxtaposed in the arrangement shown in FIG. 4, and may likewise be juxtaposed with an inclined frontal block 87. The inclined frontal block 87 includes a cutout to surround the plant box 18, as with the embodiment of FIGS. 1 through 3.

In the embodiment of FIG. 4, a relatively thin foam pad may be placed over the pit 73 to bridge the spaces between the individual subassemblies 79, 81, 83, 87, and a layer of breather material 19 stretched over this upper foam pad. The upper layer of breather material 19 serves the purposes explained in reference to FIG. 3, and can also be used to draw the subassemblies 79, 81, 83 together to avoid their eventual separation during use which would create openings in the pit surface. This layer 19 is stretched over the pit 73 by plural nylon straps 21 as shown in the embodiment of FIG. 3. The nylon straps 21 themselves are not resilient but the resilience of the foam within the pit 73 provides sufficient resilience to permit the straps 21 to draw the layer 19 taut over the pit 73. It will be recognized that these straps 21 additionally tend to draw the entire landing pit 73 together, so that these straps 21, together with the upper layer 19 tend to maintain the independent subassemblies 79, 81, 83 of the pit adjacent one another.

To further assure that the overall pit structure is closely bound together as a unitary construction, the upper cover 19 of breather material and its nylon straps 21 are slightly smaller than required to stretch over the top of the pit 73 and hook onto the plural hooks 23 (FIG. 3). Thus, the upper cover 19 itself, when placed onto the pit 73, tends to slightly deform the subassemblies 79, 81, 83, which provide resilience to permit placement of the straps 21 over the hooks 23. This resilience will maintain the subassemblies 79, 81, 83 adjacent one another during prolonged use of the landing pit 73.

As an alternate method of attaching the straps 21 to the subassemblies 79, 81, 83 of the pit 73, the straps may be made long enough to reach under the lower portion of the covers 85, as shown by the pair of frontal straps 71 of FIG. 1. These straps 71 thus require no hooks as such but are simply drawn over the lower corner of the pit 73 and serve in this manner to bind the pit structure together.

Each of the subassemblies 79, 81, 83 of FIG. 4 may be individually transported and assembled. Alternatively, these units, each surrounded by a zipper as in the embodiment of FIGS. 1 through 3, may be individually disassembled for transportation and storage.

Figure 5:
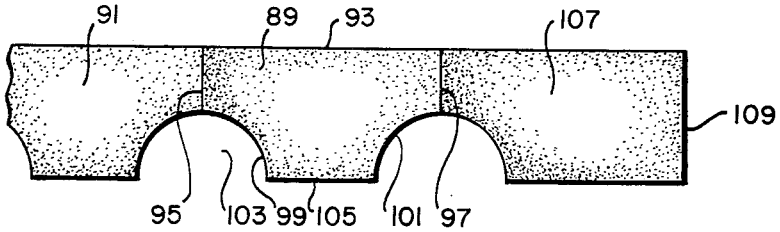
FIGS. 5 through 8 are elevation views showing the ends of various embodiments of the foam logs or blocks usable with the present invention.

Referring now to FIG. 5, an alternate shape for the individual foam blocks 31, 33, 55, 57 of the landing pit of FIGS. 1 through 3 will be described. It will be recognized that these altered foam blocks may also be used in the landing pit construction shown in FIG. 4. In the end elevation view of FIG. 5, a pair of identical blocks 89 and 91 each include a first planar surface 93 intersecting normally with planar sides 95 and 97 which extend approximately half the thickness of the blocks 89, 91. At this halfway point, the blocks 89, 91 are arcuately formed along a pair of radii 99 and 101 so that, when the blocks 89, 91 are positioned side-by-side, a semicircular air space 103 results. The arcuate side portions 99, 101 intersect with a planar side portion 105 which is parallel to the planar side portion 93 and approximately one-half the width of this side portion 93. As with the blocks previously described, an end block 107 having one planar side face 109 is used to terminate the block array to form a rectangular side for conforming to a cover structure. Also identical to the blocks previously described, the blocks 89. 91, 109 of FIG. 5 are used to build a two-layer landing pit, the first layer having the planar sides 93 facing the ground and the second layer positioned to run at right angles to this first layer with the planar surface 93 forming the top of the landing pit structure. This results in a lattice foam structure with a lattice air space structure incorporated between the foam blocks.

Figure 6:
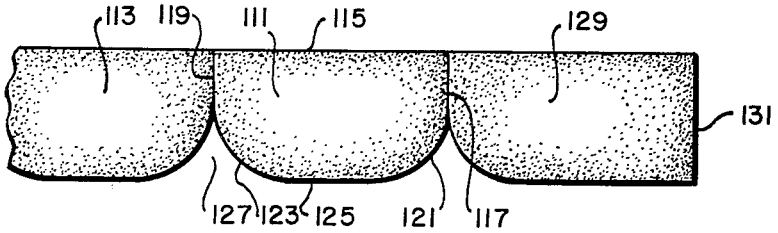

An additional alternate embodiment of the various foam blocks is shown in FIG. 6. In this instance, the blocks 111 and 113 include planar upper surfaces 115 intersecting normally with planar side surfaces 117 and 119 which again extend approximately half the height of the blocks 111, 113. At this halfway point, arcuate segments 121 and 123 extend to a lower planar surface 125 which is parallel to the planar surface 115 and approximately half the width of the planar surface 115. The construction of FIG. 6 results in arcuate-triangular air spaces 127 between adjacent blocks 113 and 115. As with the prior embodiment, a terminal block 129 is used to produce a rectangular outside edge 131. The blocks of FIG. 6 are arranged in a manner identical to the blocks of FIGS. 1 through 3 and 5 or may be used to construct a pit according to the embodiment of FIG. 4.

Figure 7:
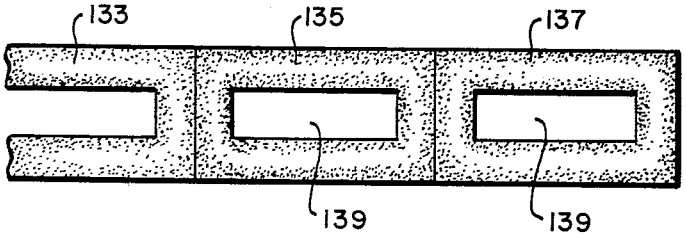
Figure 8:
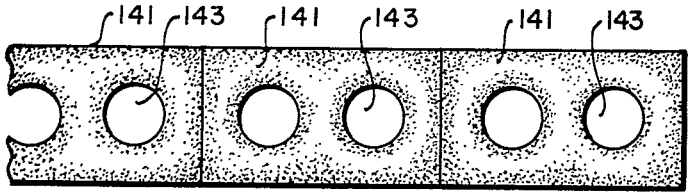

In the embodiment shown in FIG. 7, rectangular blocks 133, 135 and 137 are used to construct a landing pit, each of the blocks 133, 135, 137 including a rectangular aperture 139 running the length of the block. These rectangular apertures 139 provide the lattice air space structure when the blocks 133, 135, 137 are laid at right angles across a similar set of blocks forming a second layer for the pit structure. A similar construction is shown in FIG. 8 where plural blocks 141 each include a pair of longitudinally running, central, circular apertures 143 to provide the lattice air space structure for the landing pit. In the embodiments of FIGS. 7 and 8 it will be recognized that the air spaces 139, 143 of the upper and lower layers of the pit structure are spaced from one another. Such vertical spacing of the air space apertures 139, 143 does not deteriorate the function of these spaces 139, 143 in providing added resilience to the pit structure.

In summary, it will be appreciated that, in addition to the coffin-shaped blocks described in reference to FIGS. 1 through 3, a variety of block shapes such as those shown in FIGS. 5 through 8 may be used to form a two-layer, lattice structure, foam landing pit with lattice-arranged air spaces, that is, air spaces which run at an angle to one another in the upper and lower pit section. Each construction provides an outer rectangular surface for conforming to an outer rectangular-shaped cover structure and each provides unattached individual foam blocks or logs which are bound together by the overall landing pit cover (or covers in the case of the embodiment of FIG. 4), but which are individually transportable and storable and which may be rotated within the pit structure to spread excessive wear among the various foam block units.

What is claimed is:

1. An athlete's landing pit, comprising:

a first plurality of elongate foam blocks positioned horizontally side-by-side abutting and unattached to one another, and formed and shaped in cross section so that said first plurality provides at least one longitudinally extending void;

a second plurality of elongate foam blocks positioned horizontally side-by-side abutting and unattached to one another on top of said first plurality of blocks, said second plurality of blocks running at a right angle to said first plurality of blocks, and formed and shaped in cross section so that said second plurality provides at least one longitudinally extending void, with the void so formed running perpendicular to the void formed by the first plurality of foam blocks, the upper surfaces of said second plurality forming a composite, contiguous, planar upper cushioning surface; and a fabric cover tightly surrounding all sides of said combined first and second plurality of blocks to maintain the abuttment of said blocks.

2. An athlete's landing pit, as defined in claim 1 wherein each of said first and second plurality of foam blocks comprise blocks having a first planar side, a pair of planar sides extending normally from said first planar sides, and a remaining side formed as a truncated triangle in section, said triangular remaining side forming a triangular, longitudinally extending void when one such foam block is juxtaposed longitudinally adjacent another such foam block.

3. An athlete's landing pit as defined in claim 1 wherein said fabric cover is air impervious on the bottom and sides of said pit, and formed of breather material on the top of said pit.

4. An athlete's landing pit as defined in claim 1 additionally comprising:

a second cover stretched over the top of said fabric cover to protect said fabric cover.

5. An athlete's landing pit as defined in claim 4 additionally comprising:

plural straps for connecting said second cover to said fabric cover, said straps extending along the sides of said pit and further maintaining the abutment of said plural foam blocks.

6. An athlete's landing pit as defined in claim 1 wherein each of said first and second plurality of foam blocks includes a cutout portion centrally located on one side of said pit for surrounding the plant box used by pole-vaulters.

7. An athlete's landing pit as defined in claim 1 wherein said fabric cover is formed as a top portion and a bottom portion, said pit additionally comprising:

fastener means for removably attaching said top cover portion to said bottom cover portion.

8. An athlete's landing pit, comprising:

a plurality of independent foam blocks juxtaposed to form a cushioning layer, said blocks formed to provide a composite, contiguous planar upper foam surface for said cushioning layer, said blocks formed and shaped in cross section so that when so juxtaposed to form said layer, said plurality provides at least one longitudinally extending void extending horizontally within said cushioning layer; and a fabric cover stretched over said cushioning layer to maintain the juxtaposition of said plural foam blocks.

9. An athlete's landing pit as defined in claim 8 wherein there are a plurality of longitudinally extending voids, one of said longitudinally extending voids extends in a first horizontal direction and another of said longitudinally extending voids extends in a second horizontal direction.

10. An athlete's landing pit as defined in claim 8 wherein said fabtic cover permits the passage of air into and out of said cushioning layer.

* * * * *